US006371338B1

(12) United States Patent
Klein et al.

(10) Patent No.: US 6,371,338 B1
(45) Date of Patent: Apr. 16, 2002

(54) VALVE ARRANGEMENT FOR DISCHARGING A FLUID MEDIUM MAINTAINED UNDER PRESSURE IN A CONTAINER

(75) Inventors: Manfred Klein, Lamerdingen; Markus Kögler, Buchloe, both of (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/618,874

(22) Filed: Jul. 19, 2000

(30) Foreign Application Priority Data

Aug. 6, 1999 (DE) ..... 199 37 283

(51) Int. Cl.[7] ..... B65D 83/14
(52) U.S. Cl. ..... 222/402.1; 222/635
(58) Field of Search ..... 222/635, 402.1, 222/568

(56) References Cited

U.S. PATENT DOCUMENTS

| | | | | |
|---|---|---|---|---|
| 3,817,297 A | | 6/1974 | King | 141/20 |
| 4,522,318 A | | 6/1985 | Del Bon | 222/402.24 |
| 4,762,254 A | * | 8/1988 | Nitta | 222/402.1 |
| 4,852,807 A | | 8/1989 | Stoody | 239/337 |
| 5,097,990 A | * | 3/1992 | Goncalves | 222/402.1 |
| 6,196,276 B1 | * | 3/2001 | De Laforcade | 222/402.1 |

FOREIGN PATENT DOCUMENTS

| | | | |
|---|---|---|---|
| FR | 2508136 | * 12/1982 | 222/635 |
| GB | 1505530 | 3/1978 | |
| GB | 2096245 | 10/1982 | |

* cited by examiner

*Primary Examiner*—Joseph A. Kaufman
(74) *Attorney, Agent, or Firm*—Sidley Austin Brown & Wood, LLP

(57) ABSTRACT

A valve arrangement (1) for use in a container for discharging a fluid medium maintained under pressure in the container, particularly a cylindrical container. The valve arrangement includes a pot-shaped valve disk (2) to be secured in an open side of the container. The valve disk (2) has a coupling device (4) for connection to a container adapter of a discharging device. The valve disk (2) has a discharging valve (11) including a valve piston (12) and a restoring device (15). The pot-shaped disk valve (2) is formed of a plastics material with a plastically deformable and especially clinchable cylindrical pot wall (3). The coupling device (4) is an integral part of the valve disk (2) and is joined by thin cross sections (5) with the pot wall (3).

12 Claims, 2 Drawing Sheets

VALVE ARRANGEMENT FOR DISCHARGING A FLUID MEDIUM MAINTAINED UNDER PRESSURE IN A CONTAINER

BACKGROUND OF THE INVENTION

The present invention relates to a valve arrangement for use in a container for discharging a fluid medium maintained under pressure in the container. The valve arrangement is used especially in cylindrical pressurized cans, includes a valve disk which can be connected in an opening in the container. The valve disk is pot-shaped and has a coupling device for a connection to an adapter of a discharging device.

In trade and industry, as well as in household use and many other applications, pressurized cans are used in which a fluid medium is maintained under pressure. The fluid medium may be a lacquer, a lubricant, a cleaning agent, a foaming medium, and the like. Such pressurized cans usually have an elongated shape with an open end closed by a valve arrangement. The valve arrangement includes a valve disk connected with an edge of the opening of the pressurized can and equipped with a discharging valve for the fluid medium. A discharging valve is formed with a valve body, a valve seat with a sealing element, a seal part and a restoring element. Frequently, the valve disk is pot-shaped and equipped with a device for connection to a container adapter so that the pressurized can be connected in a fluid type manner with a manual or motor-activated discharging device. A conventional valve arrangement is well known, for example, as disclosed in EP-B-O-350779. This known valve arrangement is intended in particular for aerosol cans formed of aluminum or sheet metal. Such cans or containers have a standardized opening with a diameter of about one inch. The opening has a rolled edge serving to accommodate the valve disk. The valve disk is inserted, and is positively connected with the container by bending. This bending process is usually referred to as "clinching" or "crimping."

The valve disk forms a central part of such known valve arrangements and is formed of metal. The metal valve disk must be produced to fit exactly and, in mass production, requires expensive tools. For tightness reasons, the valve of the type disclosed in EB-P-O 350 779 has a plastics material valve seat. To produce such a metal valve disk, it must be placed in a plastics material injection mold where it is extrusion-coated with a plastics material. Aside from the additional expense of this manufacturing method, a gap may remain between the metal valve disk and the injection-coated plastics material allowing a path for the escape of an aerosol in the pressurized container. The connecting devices joining the pressurized container with the discharge device are limited to the cylindrical inner region of the pot-shaped valve disk and are formed with internal threads. Tools for producing an internal thread in the valve disk are relatively expensive and increase the cost of the manufacturing process. Moreover, many known discharging devices have standardized connection parts matched to the diameter of pressurized containers with external thread connections. As a result, separate adapters frequently are required for connecting known pressurized containers to such discharging devices. This is reflected in additional costs for manufacturing the unit and in increased assembly costs.

SUMMARY OF THE INVENTION

Therefore, a primary object of the present invention is to modify a known valve arrangement for a pressurized container so that the disadvantages previously experienced can be overcome. Accordingly, a valve arrangement is provided in which the danger of leakage is avoided. The manufacturing and assembly costs for such a valve arrangement are reduced and it is possible to provide a completed unit without separate adapter parts. In accordance with the present invention, a valve arrangement for delivering a fluid medium maintained under pressure in a container has the distinguishing features of a pot-shaped valve disk formed of a plastics material where the valve disk includes a generally cylindrical pot wall with a first wall extending transversally of the pot wall at one end and a second wall extending transversally at the opposite end with the second wall including a coupling device formed of the plastics material and located outwardly from the pot wall. A discharging valve is located within and spaced inwardly from the pot wall and includes a valve piston and a restoring element. Preferred variations and other developments form a part of the present invention. In general, a valve arrangement for discharging a fluid medium maintained under pressure in a cylindrical container includes the pot-shaped valve disk connected with the open end of the pressurized container and with a coupling device for a adapter of an discharging device. As mentioned above, the valve disk has a discharging valve, including a restoring element. The pot-shaped valve disk is formed of a plastics material and is plastically deformable, having a clinchable cylindrical pot wall. The coupling device is an integral connecting part, preferably a cylindrical external thread ring of plastics material connected by thin connecting cross members with a radially extending outer peripheral edge of the pot wall in the valve disk.

Since the pot-shaped valve disk, as a whole, is constructed as a plastics material part, subsequent injection coating of the valve disk with plastics material, such as required for the valve disks known in the state of the art, for sealing reasons and for corrosion protection, is unnecessary. As a result, gaps occurring between the metal valve disk and the injection-coated plastics material which can cause leaks from the pressurized container are avoided. The medium held in the pressurized container only contacts the plastics material valve disk. At the same time, the plastics material valve disk fulfills the sealing function. Such a valve disk is simple and can be manufactured and assembled in a cost-effective manner. The coupling device, required for assembly on a manual or motor-actuated discharging device, is formed integrally with the valve disk. Accordingly, the manufacture of the valve disk and the connecting part is performed in one step. The thin connecting cross-members, joining the connecting part with the plastics material valve disk, prevent the transfer of an impermissibly high torque or tilting movement in the valve disk. The connecting part may, for example, be in a bayonet catch. For manufacturing reasons, however, the connecting part is preferably formed as a cylindrical external thread ring. The thin connecting cross members are formed to break before the valve disk, clenched together with the edge of the opening of the pressurized container, is twisted relative to the pressurized container or lifted off by tilting. The maximum nominal torque capable of transfer by the thin connecting cross members is about 5Nm3. At larger torques, the cross members break. In the case of tilting, cross members have approximately the same strength. As a result, it is reliably prevented that the pressurized container is opened by faulty manipulation with the user coming into contact with the contents stored under pressure in the pressurized container.

The cross members, joining the connecting part with the valve disk are advantageously formed with break-off sites.

With such arrangement, it is ensured, even with manufacturing variations in the wall thicknesses of the cross members, that the permissible torque and the permissible tilting moments are not exceeded.

To ensure that the connection between the valve disk and the edge of the opening in the pressurized can is reliably tight, the valve disk is greatly deformed during the clinching operation. Accordingly, valve disks with wall thicknesses in the region of the plastically deformable pot wall of about 0.2 mm to about 1.0 mm and preferably in the range of 0.3 mm to 0.8 mm have proven to be appropriate. With such wall thicknesses, depending on the plastics material used, a sufficient natural stiffness of the valve disk is assured and the forces, required for the deformation process during connection with the edge of the container opening, can be applied without further modification by known devices.

The arrangement of the valve disk with the integral connection part, particularly in the form of an external thread ring, makes it possible to use cost-effective manufacturing procedures. Preferably, the known injection molding method is employed making it possible to manufacture large quantities of the parts required both simply and rapidly.

To increase the tightness of the connection between the plastics material valve disk and the edge of the opening in the pressurized container, an additional subsidiary seal is used in another variation of the invention. The subsidiary seal is constructed as a ring-shaped, preferably elastic sealing lip, located adjacent and outwardly on the peripheral edge of the pot-shaped wall. The sealing lip may be formed as a pressure-supported sealing element exerting the sealing effect under pressure.

Relative to the direction of flow of the fluid medium after its passage through the valve seat, since the restoring element is not in constant contact with the pressurized medium in the container, there are a larger group of materials which can be used.

In one embodiment of the invention, the restoring element is constructed as a ring shaped or sleeve shaped member, the spring body is held elastically between a ring-shaped shoulder encircling the valve disk and a cylindrical piston guide extending axially relative to the valve disk. The ring shaped spring body is formed in direct continuation with the cylindrical piston guide. The material for use as the ring-shaped spring body is a thermoplastic elastomer which can be formed by injection molding. In addition, the spring body may be a separate part formed from a rubber-like material slipped onto the valve piston. The ring shaped spring body made of rubber or an elastomer, forms an additional seal when the pressurized container is connected to a discharging device. The spring body can also be formed as a metallic helical spring or from a similar element. The rubber-elastic spring bodies or elastic plastics material rings can rebound radially during the actuation of the discharging valve.

In a preferred embodiment of a pressurized container, equipped with the valve disk of the present invention, the pot-shaped disk, mounted at the edge of the opening, is reinforced by a cylindrical, preferably metallic reinforcing sleeve with a bottom section. The reinforcing sleeve is located inside the pot wall facing the valve arrangement and together with the valve disk is connected positively, particularly by clenching, with the edge of the opening of the pressurized container. Even in the case of valve disks which have little natural stability and because of the material used and wall thickness, the positive connection with the edge of the opening of the pressurized container is permanently assured by the reinforcing sleeve. The axial forces acting on the valve disk when the container is filled are reliably absorbed. The leakproofness remains guaranteed.

The pot-shaped reinforcing sleeve is preferably a simple deep-drawn part with a wall thickness of about 0.2 mm to about 0.5 mm and its surface quality and dimensional accuracy may not be very high. The cylindrical wall of the reinforcing sleeve supports the thin-pot wall of the plastics material valve disk. The bottom section of the reinforcing sleeve supports the lower wall of the disk which is under pressure. The tool and manufacturing costs of the reinforcing sleeve are relatively small.

The invention will now be explained in greater detail with the reference to the drawings, showing an embodiment example of the invention. In the drawings:

DETAILED DESCRIPTION OF THE INVENTION

Figure 1:
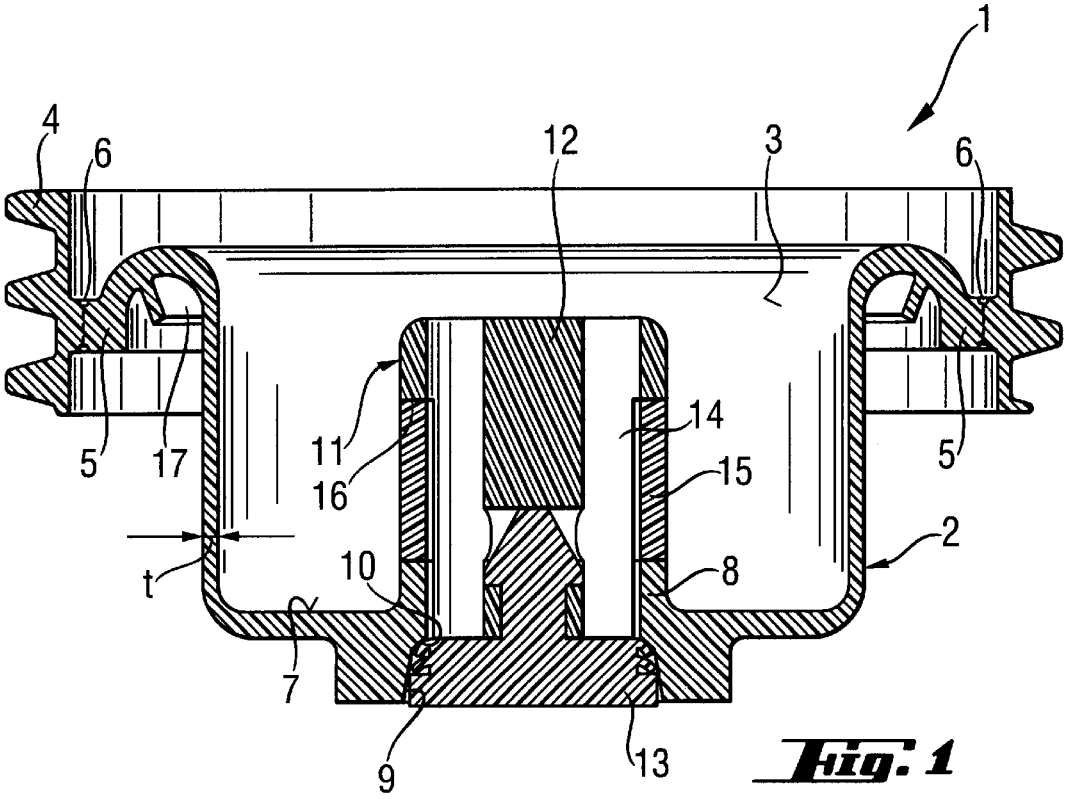
FIG. 1 is an axially extending sectional view of the valve arrangement embodying the present invention; with the valve arrangement in the closed position.
Figure 2:
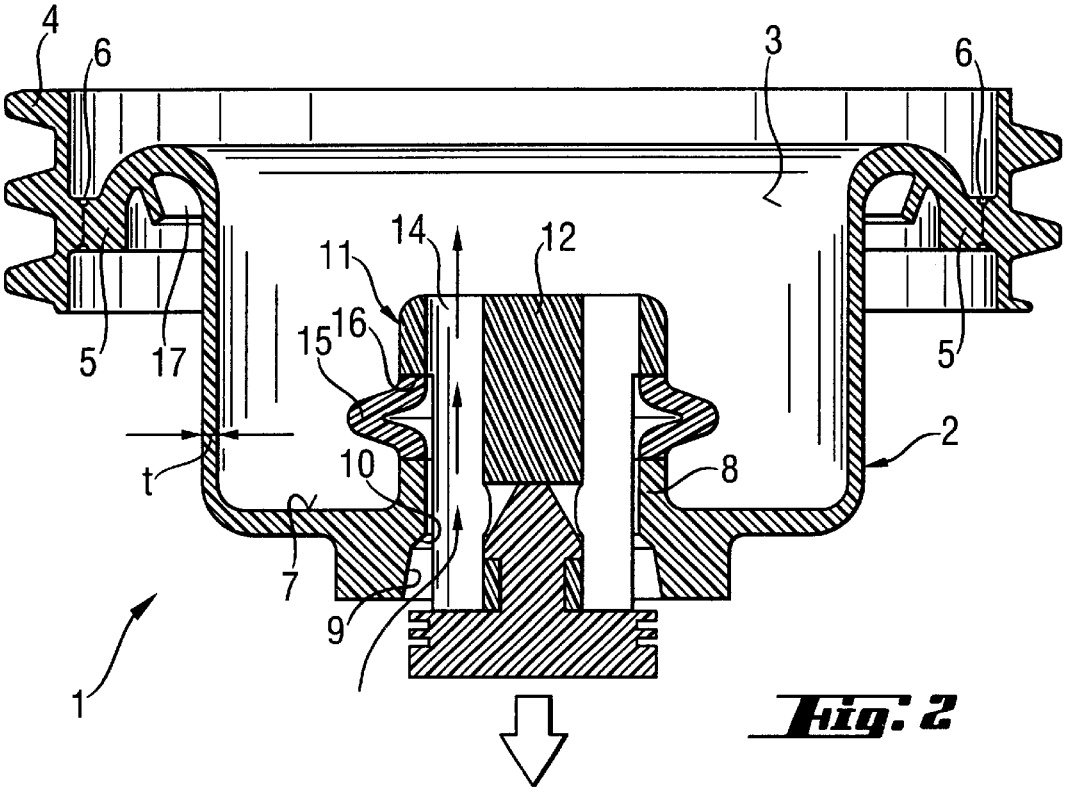
FIG. 2 is a view similar to FIG. 1 with the valve arrangement in its open position.
Figure 3:
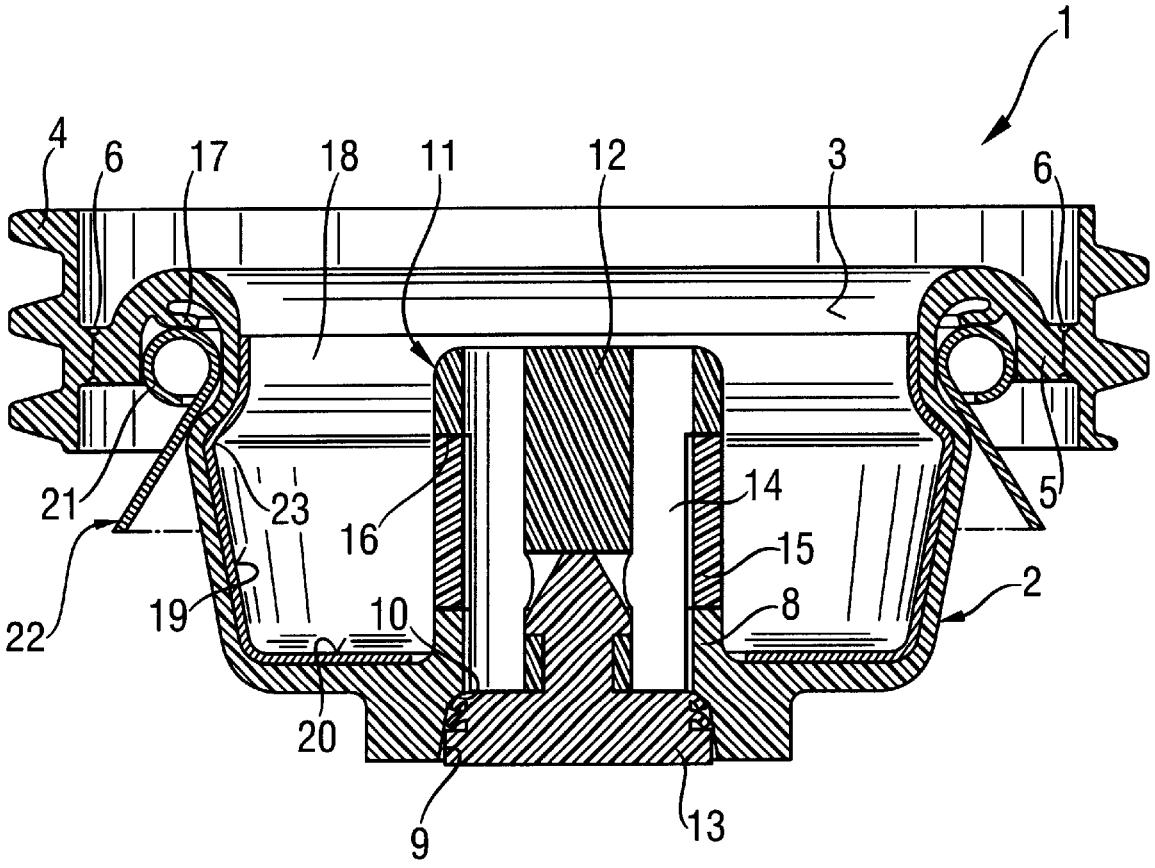
FIG. 3 is a view similar to FIG. 1 with the valve arrangement in its installed state.

In FIGS. 1 to 3, the same elements of the valve arrangement are identified by the same reference numerals. As viewed in the drawings, the valve arrangement 1 has a central axis and includes a valve disk 2 encircling the axis and formed of a plastics material as indicated by the appropriate cross-hatching. Valve disk 2 has a pot-shaped configuration with a first wall 7 forming the bottom of the top and extending transversely of the axis. A pot wall 3 encircling the axis extends upwardly from the first wall 7 and has a wall thickness in the range of about 0.2 mm to about 1 mm and preferably the range is 0.3 mm to 0.8 mm. In the bottom or first wall 7 of the pot-shaped wall disk 2, there is a central opening 9 and is continued in the upward direction by a cylindrical piston guide 8 extending upwardly from the bottom wall 7. Below the piston guide 8, the edge of the central opening 9 forms a valve seat 10. The valve disk 2 formed of a plastics material contains a discharging valve 11 encircling the axis. The discharging valve 11 includes a valve piston. 12 with a seal 13 arranged to close the valve seat 10 and a ring like or sleeve like restoring element 15 spaced outwardly from and encircling the valve piston shaft 12. Seal 13 is formed with elastic lamellas and, in the closed state of the discharging valve 11, as shown in FIG. 1, lay against the valve seat 10 and form a seal for it. The restoring element 15 is a ring-shaped or axially extending sleeve like element held between the piston guide 8 and an encircling shoulder 16 on the radially outer part of the valve shaft piston 12. Valve shaft piston 12 has at least one axially extending flow channel 14 which, in the open state of the discharging valve 11 (FIG. 2) along with the central opening 9 of the valve disk, forms a discharging opening for the pressurized medium in the container. As can be noted in FIG. 2, the restoring element 15 has a radial elasticity forming a ring-shaped protrusion when the discharging valve is activated. In other words, the discharging valve moves from the closed condition shown in FIG. 1 to the open condition in FIG. 2 with the protrusion in the restoring element projecting radially outwardly.

The valve disk 2 has an upper second wall projecting radially outwardly from the upper end of the pot wall 3 and the underside of the second wall has an encircling sealing lip 17 which in the installed state of the valve disk (FIG. 3) forms a subsidiary seal for the pressurized container 2. The wall thickness of the sealing lip 17 is such that its elastic deformability is insured. The radially outer surface of the second wall forms an external thread ring 4 which provides a coupling device for a container adapter of a discharging device. The ring 4 is connected by thin connecting cross members 5 with an inner portion of the second wall of the valve disk 2. Connecting cross members 5 are provided with break off sites 6 indicated by broken lines and break when a maximum permissible torque or tilting moment is exceeded.

FIG. 3 shows the valve arrangement 1 of FIGS. 1 and 2 installed on the open end of the pressurized container 22 shown only in part. Valve disk 2 is positively connected with the edge 21, preferably by clinching it with the edge 21 of the opening in the pressurized container. The encircling bead 23 formed by the clinching action is shown in FIG. 3. The sealing lip 17 affords a pressure-supported sealing element. The sealing effect of the lip 17 is reinforced by the pressure of the medium within the pressurized container 22. The valve disk 2 is reinforced by a cylindrical reinforcing sleeve 18 located within the pot wall 3 and, along with the valve disk 2, is positively connected with the pressurized container 22. The reinforcing sleeve has an upwardly extending cylindrical wall section 19 bearing against the interior of the pot wall 3 and a bottom section 20 of the sleeve has a central recess and extends inwardly from the lower end of the wall section 19. Due to this arrangement, the valve disk is supported on the bottom first wall 7 as well as the pot wall 3. The reinforcing sleeve 18 is a simple deep drawn sheet metal part with a wall thickness in the range of about 0.2 to about 0.5 mm.

What is claimed is:

1. A valve arrangement for use in a container for discharging a fluid medium maintained under pressure in the container, said valve arrangement comprising a valve disk (2) to be connected in an opening in the container, said valve disk (2) is pot shaped comprising an axis, a pot wall (3) encircling the axis, a first wall 7 extending transversely of the axis and located at one end of said pot wall (3), a second wall extending transversely of the axis and located at an opposite end of said pot wall (3) from said first wall (7), said second wall including a coupling device (4) spaced radially outwardly from said pot wall (3) for connection to a container adapter of a discharging device, a discharging valve (11) located within and spaced inwardly of said pot wall (3) and including a valve piston shaft (12) and a restoring element (15), said valve disk (2) is formed of a plastics material, said pot wall (3) is cylindrical and is plastically deformable, said coupling device (4) comprises an integral connecting part of the said second wall and is connected to said pot wall (3) by thin connecting cross members (5) located in said second wall between said coupling device (4) and said opposite end of said pot wall (3), said coupling device (4) comprises a cylindrical external thread plastics material ring and said thin connecting cross members (5) have break-off sites (6).

2. A valve arrangement as set forth in claim 1, wherein said plastically deformable pot wall (3) has a wall thickness (t) in the range of about 0.2 mm to about 1.0 mm.

3. A valve arrangement, as set forth in claim 2, wherein said pot wall has a thickness (t) in the range of 0.3 mm to 0.8 mm.

4. A valve arrangement, as set forth in claim 1, wherein said valve disk (2) including the coupling device (4) is an injection molded part.

5. A valve, as set forth in claim 1, wherein a ring shaped elastically deformable sealing lip (17) is formed in said second wall of said valve disk and extends downwardly toward the first wall (7) and is arranged to form a subsidiary seal with the pressurized container about the open end thereof.

6. A valve arrangement, as set forth in claim 1, wherein an opening (9) is located in said first wall (7) of the said valve disk (2), said opening in said first wall (7) and said valve piston shaft (12) form a valve seat (10) and said valve disk has a sleeve shaped section (8) extending upwardly from said first wall (7) towards said second wall, and said restoring element (15) is located between said sleeve shaped section (8) and extends upwardly towards said second wall.

7. A valve arrangement, as set forth in claim 6, wherein said restoring element (15) is an axially extending sleeve shaped spring body held elastically between a ring shaped shoulder (16) on said valve piston shaft (12) and said sleeve shaped section (8) extending axially upwardly from said first wall (7) of said valve disk (2).

8. A valve arrangement, as set forth in claim 7, wherein said sleeve shaped restoring element (15) is elastically displacable between a closed position of said valve disk and an open position of said valve disk wherein an annular portion of said restoring element (15) in the open position protrudes radially outwardly toward said pot wall (3).

9. A pressurized container for a fluid medium maintained under pressure, including a valve arrangement as set forth in claim 1, wherein said container has an opening with an encircling edge (21), said disk valve (2) is secured around said edge (21), said disk valve (2) is reinforced within said pot wall by a cylindrical reinforcing sleeve (18) extending in the axial direction with a bottom section (20) extending transversely of the axial direction, said reinforcing sleeve (18) being in contact with the pot wall of said valve disk and with the bottom section (20) of said reinforcing sleeve (18) contacting the first wall (7) of said valve disk (2).

10. A pressurized container, as set forth in claim 9, wherein said reinforcing sleeve (18) is formed of a metallic material.

11. A pressurized container, as set forth in claim 9, wherein said valve disk (2) is in clinched engagement with the edge (21) of said pressurized container (22).

12. A pressurized container, as set forth in claim 9, wherein said reinforcing sleeve (18) is a deep drawn part and has a wall thickness in the range of about 0.2 mm to about 0.5 mm.

* * * * *